US005095545A

United States Patent [19]

Lane

[11] Patent Number: 5,095,545

[45] Date of Patent: Mar. 17, 1992

[54] SWIMMING CAP

[76] Inventor: Matthew T. Lane, 722 Elm St., Bowling Green, Ohio 43402

[21] Appl. No.: 484,982

[22] Filed: Feb. 26, 1990

[51] Int. Cl.[5] ..... A42B 1/12

[52] U.S. Cl. ..... 2/68; 2/413

[58] Field of Search ..... 2/68, 411, 413, 202, 2/205, DIG. 3, DIG. 10

[56] References Cited

U.S. PATENT DOCUMENTS

| | | | |
|---|---|---|---|
| 3,259,912 | 7/1966 | Lima et al. | 2/68 |
| 3,381,305 | 5/1968 | Buzzelli | 2/68 |
| 3,447,164 | 6/1969 | Greenhouse | 2/68 |
| 4,354,284 | 10/1982 | Gooding | 2/413 |
| 4,375,108 | 3/1983 | Gooding | 2/413 |

FOREIGN PATENT DOCUMENTS

| | | | |
|---|---|---|---|
| 458497 | 10/1926 | Fed. Rep. of Germany | 2/411 |
| 2614892 | 10/1977 | Fed. Rep. of Germany | 2/411 |
| 254900 | 9/1927 | Italy | 2/411 |
| 701073 | 12/1953 | United Kingdom | 2/68 |

*Primary Examiner*—Werner H. Schroeder

*Assistant Examiner*—Sara M. Current

*Attorney, Agent, or Firm*—Leon Gilden

[57] ABSTRACT

A cap construction including an exterior layer coextensive with an interior layer defining an cap-shaped structure including an elastomeric band to enhance securement of the structure overlying a swimmer's head portion. Sandwiched between the layers are a matrix of enclosed pneumatic chambers to afford a protective covering to the swimmer in use. A modification of the instant invention includes a plurality of coaxially aligned pneumatic chambers directed exteriorly through the opposed layers defining an elongate chamber defined by an ellipse of revolution. A further modification of the instant invention includes a series of spherical chambers captured between the layers including interconnecting conduits, wherein the conduits are secured at intersections with each pneumatic sphere defining a medial axis about each intersection with apertures directed through the conduits interiorly of the pneumatic chambers, or spheres to permit equalization of pressure throughout the matrix of spheres.

1 Claim, 4 Drawing Sheets

PRIOR ART

SWIMMING CAP

BACKGROUND OF THE INVENTION

1. Field of the Invention

The field of invention relates to swimming caps, and more particularly pertains to a new and improved swimming cap wherein the same includes pneumatic chambers to afford protection to an individual's head in a swimming event.

2. Description of the Prior Art

Swimming caps of various types are utilized to provide a water-tight seal with respect to an individual's head under the cap, and wherein the material is generally of a stretch-type material to overlie and afford protection to an individual's head within the cap structure. Prior art swimming caps are exemplified by U.S. Pat. No. 3,403,406 to Weissberg wherein a swimming cap includes a perimeter chamber, as well as a medially chamber overlying the head of an individual.

U.S. Pat. No. 3,394,406 to Bergens provides a waterproof bathing cap with a central valve directed into a spiral-like network of conduits to provide conduit chambers for affording protection to an individual.

U.S. Pat. No. 3,259,912 to Lima, et al., provides a swim cap construction utilizing a network of various encapsulated conduits throughout the cap to afford protection to an individual.

U.S. Pat. No. 3,321,772 to Arps, et al., illustrates the use of various cushions and chambers utilized in cap construction.

U.S. Pat. No. 3,480,967 to Hanford provides the use of a manually inflatable conduit directed interiorly of the cap to afford protection to an individual utilizing the cap structure.

As such, it may be appreciated that there continues to be a need for a new and improved swimming cap as set forth in the instant invention which addresses both the problems of ease of use, as well as effectiveness in providing a matrix of sealed pneumatic chambers throughout the cap to afford protection to an individual wearing the cap and in this respect, the present invention substantially fulfills this need.

SUMMARY OF THE INVENTION

In view of the foregoing disadvantages inherent in the known types of swim caps now present in the prior art, the present invention provides a swimming cap wherein the same utilizes discrete pneumatic chambers captured between layers of an associated swim cap to afford protection to an individual utilizing the cap structure. As such, the general purpose of the present invention, which will be described subsequently in greater detail, is to provide a new and improved swimming cap which has all the advantages of the prior art swim caps and none of the disadvantages.

To attain this, the present invention provides a cap construction including an exterior layer coextensive with an interior layer defining a cap-shaped structure including an elastomeric band to enhance securement of the structure overlying a swimmer's head portion. Sandwiched between the layers are a matrix of enclosed pneumatic chambers to afford a protective covering to the swimmer in use. A modification of the instant invention includes a plurality of coaxially aligned pneumatic chambers directed exteriorly through the opposed layers defining an elongate chamber defined by an ellipse of revolution. A further modification of the instant invention includes a series of spherical chambers captured between the layers including interconnecting conduits, wherein the conduits are secured at intersections with each penumatic sphere defining a medial axis about each intersection with apertures directed through the conduits interiorly of the pneumatic chambers, or spheres to permit equalization of pressure throughout the matrix of spheres.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swimming cap which has all the advantages of the prior art swim caps and none of the disadvantages.

It is another object of the present invention to provide a new and improved swimming cap which may be easily and efficiently manufactured and marketed.

It is a further object of the present invention to provide a new and improved swimming cap which is of a durable and reliable construction.

An even further object of the present invention is to provide a new and improved swimming cap which is susceptible of a low cost of manufacture with regard to both materials and labor, and which accordingly is then susceptible of low prices of sale to the consuming public, thereby making such swimming caps economically available to the buying public.

Still yet another object of the present invention is to provide a new and improved swimming cap which provides in the apparatuses and methods of the prior art some of the advantages thereof, while simultaneously overcoming some of the disadvantages normally associated therewith.

Still another object of the present invention is to provide a new and improved swimming cap wherein the same utilizes captured discrete pneumatic chambers defined in an ordered matrix array to afford protection to an individual swimmer wearing the cap structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
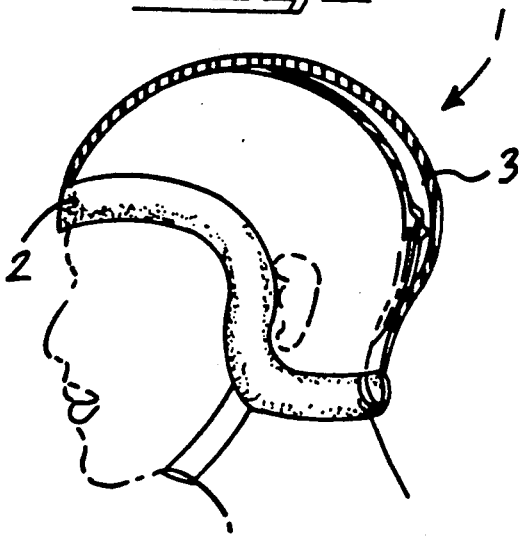
FIG. 1 is an orthographic side view taken in elevation of a prior art swim cap.

With reference now to the drawings, and in particular to FIGS. 1 to 8 thereof, a new and improved swimming cap embodying the principles and concepts of the present invention and generally designated by the reference numerals 10, 10*a*, and 10*b* will be described.

Figure 2:
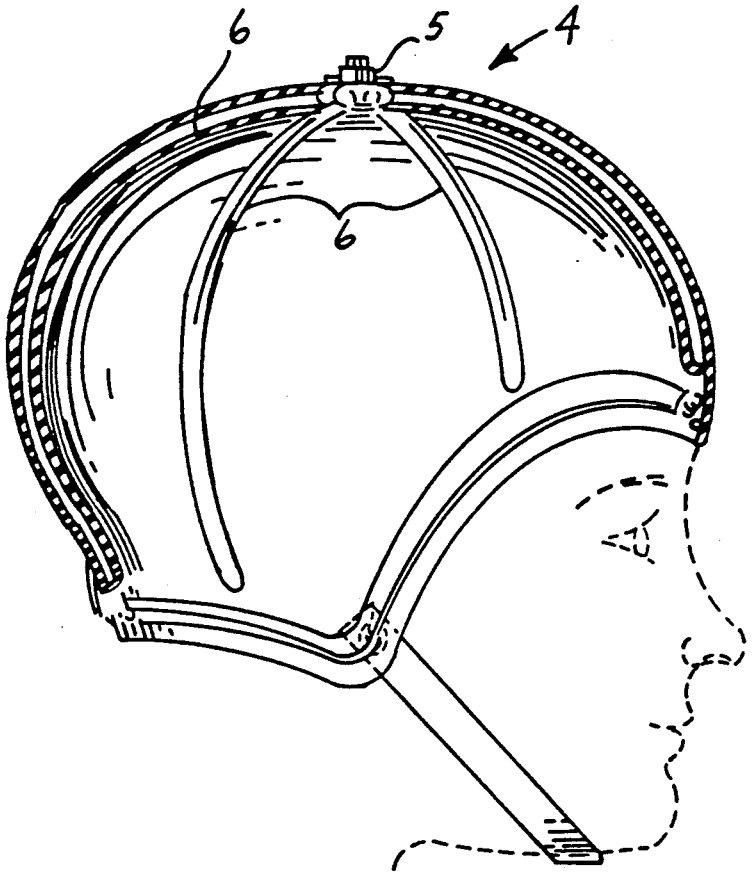
PRIOR ART Fig 2
FIG. 2 is an orthographic side view, partially in section, of a further prior art swim cap construction.

FIG. 1 illustrates a prior art swimming cap 1 wherein the swimming cap includes a first conduit 2 formed about the opening perimeter of the swimming cap, with a medial chamber 3 directed medially about the swim cap to afford additional protection to the user of the swimming cap. FIG. 2 illustrates a further prior art swimming cap 4 wherein a valve 5 directs selective and pneumatic pressure within the spider-like conduits 6 formed throughout the cap originating at the valve 5.

Figure 3:
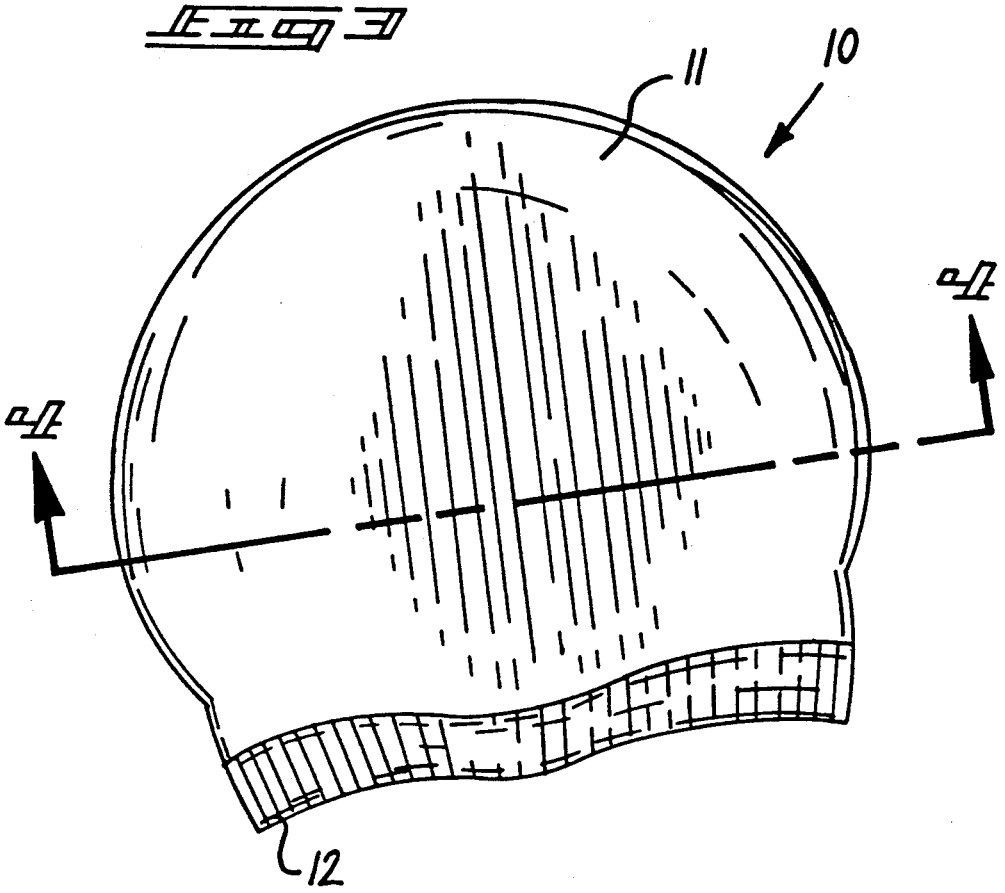
FIG. 3 is an orthographic side view taken in elevation of the instant invention.
Figure 4:
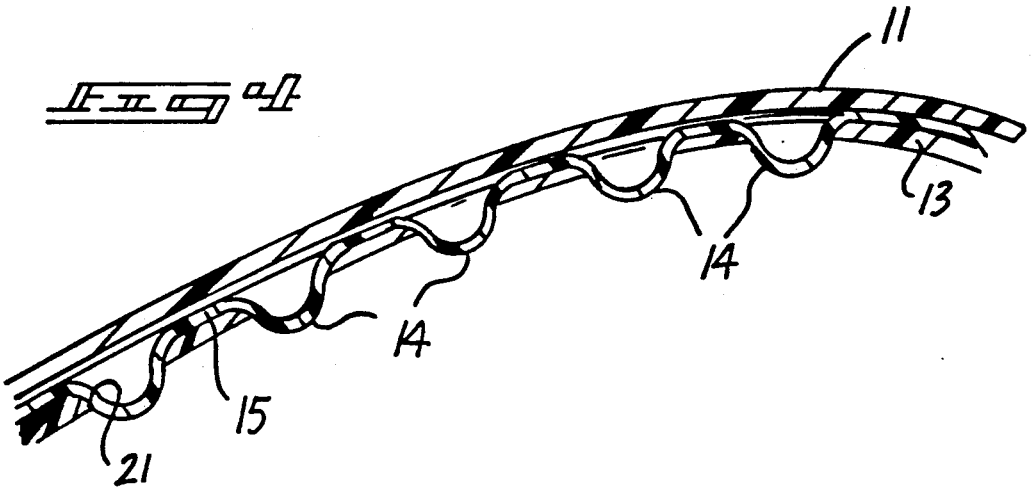
FIG. 4 is an orthographic view taken along the lines 4—4 of FIG. 3 in the direction indicated by the arrows.

More specifically, the swimming cap construction 10 of the instant invention essentially comprises a cap-like structure, as illustrated in FIG. 3 for example, including an outer liner 11 coextensively mounted to an inner liner 13. An elastomeric band 12 is optionally provided at an entrance to the inner and outer liner to enhance securement of the cap structure to an individual's head. A matrix of first pockets 14 are coextensively formed throughout the cap and project interiorly of the cap through the inner liner 13 through inner liner apertures 21. The first pockets 14 are a projecting portion of a first intermediate liner 15 coextensively with and laminated to interior surfaces of the inner and outer liners 13 and 11 respectively. The pockets 14 are filled with a predetermined quantity of pneumatic pressure to provide a bubble-like cushion afforded to a surface of an individual's head during use of the cap.

Figure 5:
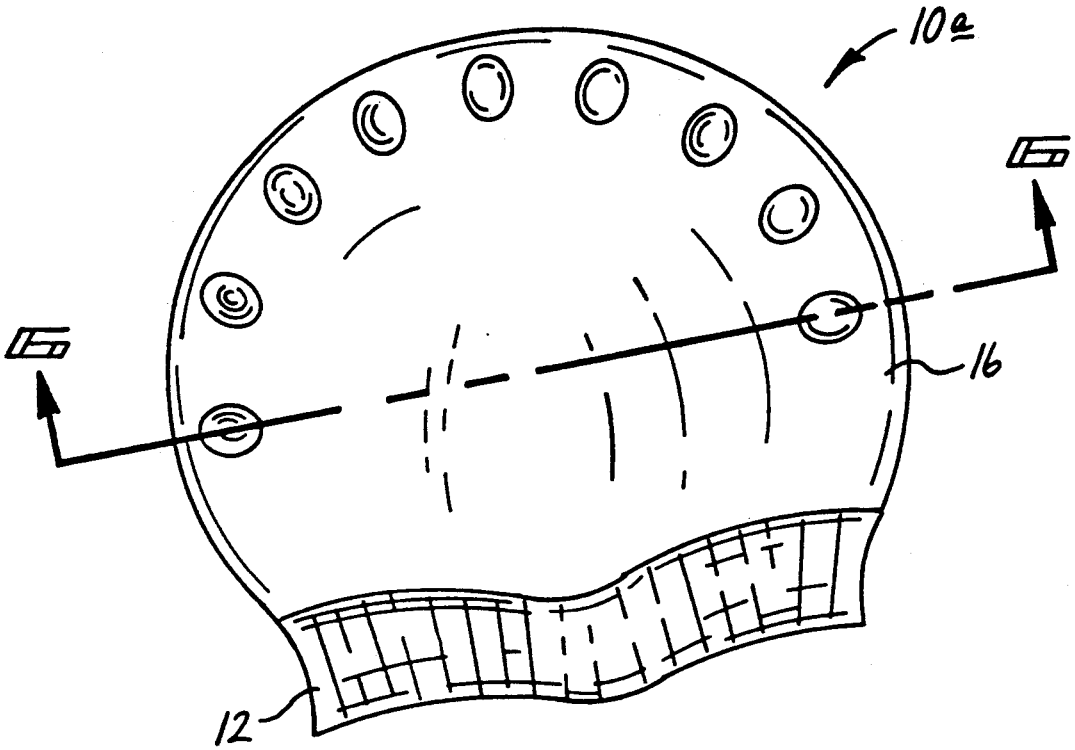
FIG. 5 is an orthographic side view taken in elevation of a further swimming cap of the instant invention.
Figure 6:
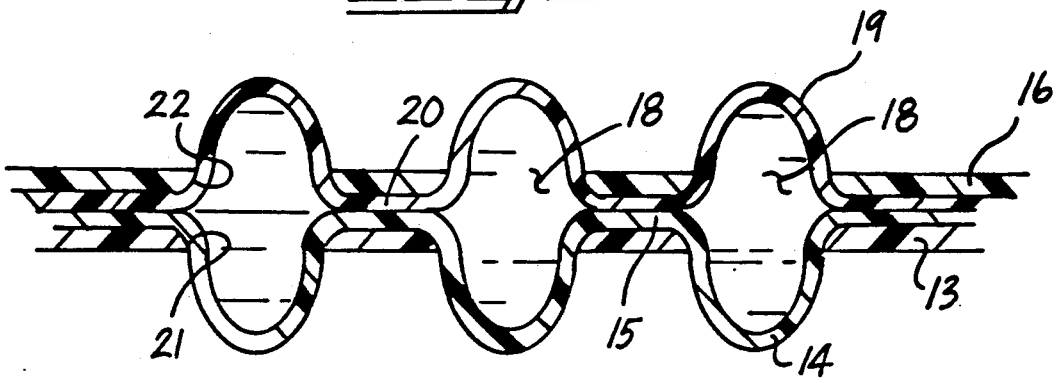
FIG. 6 is an orthographic view taken along the lines 6—6 of FIG. 5 in the direction indicated by the arrows.

FIG. 5 illustrates a modified swimming cap 10*a* utilized by the instant invention wherein a modified outer liner 16 is utilized formed with a series of outer liner apertures 22 coaxially aligned with the inner liner apertures 21. A second intermediate liner 20 is mounted coextensively with the first intermediate liner 15, and wherein the second intermediate liner 20 includes a like number of coaxially aligned second pneumatic pockets 19 aligned with the first pneumatic pockets 14. The resultant elongate, egg-shaped chamber 18 thusly defined affords an enhanced degree of protection to impact in use of the cap structure.

Figure 7:
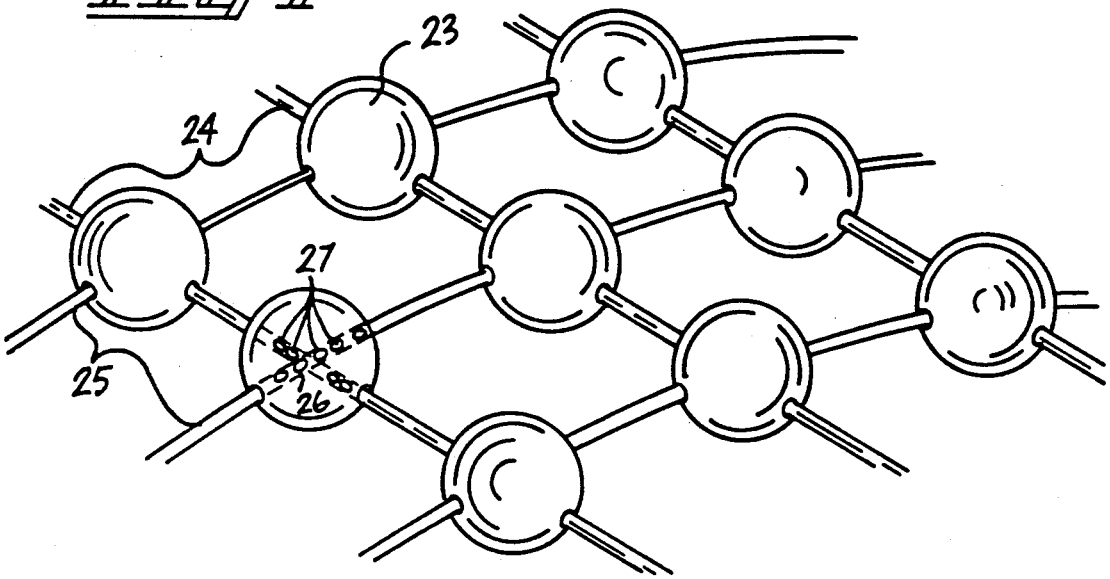
FIG. 7 is an isometric illustration of a further matrix of captured pneumatic chambers mounted between the layers of the swim cap.
Figure 8:
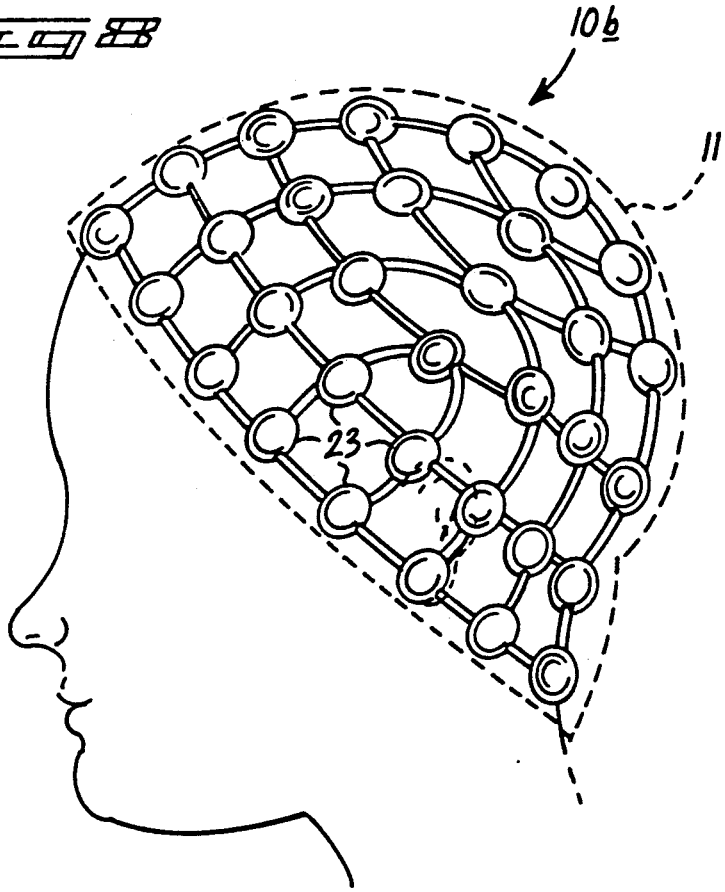
FIG. 8 is an orthographic side view taken in elevation of the improved pneumatic chambers, as illustrated in FIG. 7, secured within the layered swimming cap as illustrated.

FIG. 7 and FIG. 8 illustrate a network of spherical chambers 23 utilized for mounting between the inner and outer liners of FIG. 3, wherein the spherical chambers 23 are arranged in a square-like matrix configuration defined by spaced rows and spaced columns of respective conduits 24 and 25. The rows and columns of conduits 24 and 25 respectively intersect at intersections 26 and are fixedly mounted to one another at those intersections, wherein conduit openings 27 formed through each of the conduits 24 and 25 are confined only to areas within the spherical chambers 23 to accordingly equalize pressure throughout the network of spherical chambers 23 upon impact to the cap structure during use. It is understood that in the organization of FIG. 3, the spherical pneumatic chambers 23 will project exteriorly through the inner liner apertures 21 in lieu of the first pockets 14, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A swimming cap defined by a hollow cavity receiving an individual's head within the cap and utilizing flexible fluid impermeable material including, an outer liner coextensively formed to an inner liner, wherein the outer and inner liners each terminate in a central opening defined by a continuous elastomeric band formed about the opening, and a matrix of pneumatic chambers secured between the inner and outer liner, and wherein the inner liner includes a matrix of inner liner openings, the inner liner openings coaxially aligned with the pneumatic chambers to permit projection of the pneumatic chambers through the inner liner openings, and wherein the pneumatic chambers are spherical, and including equally spaced rows of conduits coaxially intersecting the spherical pneumatic chambers, and further including equally spaced columns of conduits intersecting the pneumatic chambers, wherein the columns and rows of conduits intersect each other orthogonally, and wherein each of the spherical pneumatic chambers is geometrically formed about an intersection of the rows and columns of conduits, and wherein intersections of the rows and columns of conduits are defined by an integral association of the respective rows and columns of conduits within each respective spherical pneumatic chamber, and including conduit openings directed through the rows and columns of conduits confined interiorly within the respective spherical pneumatic chambers to permit equalization of pneumatic pressure between the spherical pneumatic chambers, and wherein the pneumatic chambers are mounted to an intermediate liner, and the intermediate liner coextensively mounted between the inner and outer liner, and further including a second intermediate liner, with the second intermediate liner including a second matrix of spherical chambers, each second spherical chamber of the matrix of second spherical chambers coaxially aligned with each first pneumatic chamber of the first matrix of spherical chambers, and wherein the outer liner includes liner apertures coaxially aligned with the inner liner apertures, and wherein the second matrix of pneumatic chambers project exteriorly of the outer liner apertures.

* * * * *